United States Patent [19]

Cockel et al.

[11] Patent Number: 4,843,665

[45] Date of Patent: Jul. 4, 1989

[54] PATIENT TRANSPORT AND BED COMFORT AID

[76] Inventors: Ray S. Cockel, 2040 Mission Ridge Rd; Pauline V. Shakas, 1620 Lasuen, both of Santa Barbara, Calif. 93103

[21] Appl. No.: 179,575

[22] Filed: Apr. 8, 1988

[51] Int. Cl.[4] ..... A61G 7/10

[52] U.S. Cl. ..... 5/65; 5/81 R; 5/84; 5/89

[58] Field of Search ..... 5/60, 65, 81 R, 83, 5/84, 86, 88, 89, 109

[56] References Cited

U.S. PATENT DOCUMENTS

| | | | |
|---|---|---|---|
| 317,383 | 5/1885 | Leslie | 5/89 X |
| 2,774,079 | 12/1956 | Flatley | 5/89 X |
| 2,831,201 | 4/1958 | Limbach | 5/86 X |
| 2,884,651 | 5/1959 | Garey | 5/109 |
| 3,099,842 | 8/1963 | Jensen | 5/89 X |
| 3,108,290 | 10/1963 | Pavtridge | 5/88 |
| 3,346,890 | 10/1967 | Thompson | 5/89 X |
| 3,701,170 | 10/1972 | Bond | 5/81 R X |
| 3,905,055 | 9/1975 | Blair | 5/81 R X |
| 4,222,133 | 9/1980 | Csatary | 5/84 X |

FOREIGN PATENT DOCUMENTS

| | | | |
|---|---|---|---|
| 92784 | 11/1983 | European Pat. Off. | 5/109 |

*Primary Examiner*—Gary L. Smith
*Assistant Examiner*—Michael F. Trettel
*Attorney, Agent, or Firm*—Donald A. Streck

[57] ABSTRACT

A patient comfort and convenience device for use in conjunction with a hospital bed having a mattress disposed between a spaced headboard and footboard and a mechanized drive for raising and lowering the mattress. There is a first support structure disposed between the footboard and the mattress, the first support structure including a pair of spaced vertical first members disposed at respective ones of a pair of foot corners of the mattress. There is also a second support structure disposed between the headboard and the mattress, the second support structure including a pair of spaced vertical second members disposed at respective ones of a pair of head corners of the mattress. A pair of rigid side rails are disposed between respective ones of the first and second members along and above upper side edges of the mattress. A fabric sling is disposed between the side rails. Preferably, the side rails are releasably attached to the tops of the vertical members and there are addition supporting devices on wheels configured as, for example, a gurney cart, an ambulance stretcher, and a wheelchair to allow the patient to be maintained in the device from pickup to hospital room. The side rails each include opposed, lockable, pivoting joints therein whereby the side rails can be bent into a chair shape or permit the patient to sit up. There is a controller for controlling the mattress and the sling in combination through steps allowing patient turning, etc. The sling is made of a porous, non-absorbent plastic material and there is a drain pan for placement on the mattress under the sling to catch water passing through the sling so the patient can be bathed. The sling also has a closable centrally located hole positioned under the genital area of a patient in the sling.

18 Claims, 12 Drawing Sheets

PATIENT TRANSPORT AND BED COMFORT AID

BACKGROUND OF THE INVENTION

The present invention relates to hospital beds and, more particularly, to a sling and attendant support structure which can be used to provide benefits to the patient during transport and/or subsequent bed confinement.

The typical hospital bed has remained virtually unchanged for years except for the replacement of hand cranks with electric motors for adjustment purposes. As shown in FIGS. 1–4, a hospital bed 10 has a headboard 12 and a footboard 14 connected by side rails 16. There is a support platform 18 having a mattress 20 thereon. As shown in FIG. 3, the support platform 18 can be raised and lowered in a horizontal position by a power mechanism (not shown) driving the roller-ended members 22. The power mechanism is controlled by a hand-held controller 24 which can be operated by a patient in the bed 10 or by members of the hospital staff. Removable safety rails (shown ghosted as 26) can be attached to the brackets 28 to prevent a patient from falling or rolling out of the bed. As shown in FIG. 4, the support platform 18 can be raised and lowered on the ends individually by the power mechanism driving one of the roller-ended members 22 so as to permit, for example, sitting up of the patient supported by the mattress 20.

As anyone who has spent any time in a hospital well knows, prior art hospital beds such as that described above are less than ideal for long term occupancy, as in the case of bed-ridden patients. Skin ulcer or "bed sores" are a common problem as the patient's body is supported on point of projection such as hip bones, spine, shoulder blades, etc. This is particularly true in terminal cases where there is much loss of body weight. Air cushions, sheep skins, and the like, are commonly employed in an effort to eliminated this common problem. Moreover, patients in a weakened condition are unable to change heir position on the surface of the bed without assistance. If there is not constant attention by the hospital staff in, this regard, the problem in magnified.

The typical hospital bed has numerous other problems as well, even for the "casual" user. It has a hard mattress and is uncomfortable. Bathing for patients who cannot leave the bed is a joke at best. Also, the typical hospital bed does nothing in the way of assisting the hospital staff in "turning" patients, who may be overweight and unable to assist in their own turning. Most hospitals have rules against staff members attempting to turn patients on their own because of the danger of back injury to the staff member in such a process. Due to lack of available staff, haste, or numerous other reasons, this rule is often ignored—with attendant injury to staff members. In situations of "home care" the typical hospital bed (which can be rented for home use when needed) is unsuitable, at best, in all but the most trivial circumstances. Usually, the caretaker(s) are unskilled and/or physically unsuitable for dealing with a helpless patient when it comes to simple things like turning the patient or the use of a bedpan. The bed itself offers no way that the patient can use a bedpan without inflicting pressure therefrom on already tender areas of the posterior regions of the body.

Not only that, the typical patient picked up from a "home" environment, or the like, with, for example, a heart attack, is moved from one type of transport and support to another in the process—at a time when they least want to be so moved. The ambulance crew moves the patient from a bed to a ambulance stretcher having a collapsible wheeled support. If there is a narrow turning hallway or stairs involved at the pickup site, the stretcher may not fit through requiring hand movement and subsequent transfer to the stretcher at a removed location. At the hospital, the patient is transferred from the ambulance stretcher to a hospital gurney and from there, ultimately, to a hospital bed with, perhaps, an intermediate stop on an X-ray table.

Moreover, a prior art hospital bed does nothing to comfort gravely ill patients. It provides merely a cold, impersonal environment. And, prior art hospital beds do nothing to provide for a patient's feeling of self sufficiency. That is, the patient often needs help merely to change position giving that patient a feeling of loss and dependency when it would be more beneficial to provide them with a feeling of self sufficiency—which would aid in the healing process. This is particularly true of elderly and infirm patients in nursing homes and the like. Being able to attend to one's basic needs imparts a feeling of self worth which is important to good health and mental well being.

In today's environment of highly contagious and deadly diseases such as AIDS, for which there is no cure, the modern hospital bed does nothing with respect to providing a sanitary, non-absorbant environment having patent contact materials which are easily and economically disposable.

Wherefore, it is an object of the present invention to provide a system for use in conjunction with prior art hospital beds which will provide a more comfortable environment for a patient therein.

It is another object of the present invention to provide a system for use in conjunction with prior art hospital beds which will permit patients therein to provide additional services of self-help to themselves.

It is yet another object of the present invention to provide a system for use in conjunction with prior art hospital beds which can provide patients therein with a comforting environment, if necessary including tactile stimulation, rocking or vertibrilar stimulation, heartbeat vibration stimulation, and privacy sidewalls.

It is still another object of the present invention to provide a system for use in conjunction with prior art hospital beds which can provide a single surface of support for a patient from the home bed through the hospital bed wherein there is a reduction of trauma caused by hard surfaces and the elimination of trauma caused by road vibrations and plane turbulance and which can be maneuvered in areas of restricted access such as turning corners, and the like.

It is also an object of the present invention to provide a system for use in conjunction with prior art hospital beds which can provide assistance to hospital staff members in turning patients therein.

It is also an additional object of the present invention to provide a system for use in conjunction with prior art hospital beds which can provide a convenient and sanitary method of bathing patients therein, aiding the unskilled and/or physically unsuited caretaker, or the patient himself, in patient turning, and using of a bedpan in a manner which is more easily accomplished and provides for non-pressure on the patient's posterior regions during use thereof.

It is yet another object of the present invention to provide a system for use in conjunction with prior art hospital beds which can provide an improved patient environment providing turning ease, multiple positioning, air circulation and foot and head elevation for blood distribution particularly useful in the preventing bed sores or ulcers.

It is still a further object of the present invention to provide a system for use in conjunction with prior art hospital beds providing a sanitary, non-absorbant environment employing patent contact materials which are easily and economically disposable for use with patients having highly contagious and deadly afflictions, such as AIDS, for which there is presently no cure.

Other objects and benefits of the present invention will become apparent from the description which follows hereinafter when taken in conjunction with the drawing figures which accompany it.

SUMMARY

The foregoing objects have been achieved by the patient comfort and convenience device of the present invention adapted for or use in conjunction with a hospital bed having a mattress disposed between a spaced headboard and footboard and a mechanized drive for raising and lowering the mattress comprising, a first support structure disposed between the footboard and the mattress, the first support structure including a pair of spaced vertical first members disposed at respective ones of a pair of foot corners of the mattress; a second support structure disposed between the headboard and the mattress, the second support structure including a pair of spaced vertical second members disposed at respective ones of a pair of head corners of the mattress; a pair of rigid side rails disposed between respective ones of the first and second members along and above upper side edges of the mattress; and, a fabric sling disposed between the side rails.

In the preferred embodiment, at least one of the support structures is attached to the adjacent headboard or footboard whereby when the hospital bed is moved the comfort and convenience device moves in combination with the bed. Also in the preferred embodiment, the side rails are releasably attached to the tops of the vertical members.

As an added feature in the preferred embodiment, there are additional support means having wheels for rolling the support means thereon and a plurality of vertical support members for releasably holding the side rails whereby the side rails and the sling in combination can be manually lifted off of and onto the vertical support members and the support means can be used to move the side rails and the sling in combination with a patient thereon from place to place. In various embodiments, the support means is configured as a gurney cart, as a stretcher having folding wheel supports for use in an ambulance, and as a wheelchair.

To provide additional capabilities in the preferred embodiment, the side rails each includes a pair of opposed, lockable, pivoting joints therein whereby the side rails can be bent into a chair shape and/or ca bend to allow the patient to sit up in bed without removing the present invention.

In an automated version of the present invention, each of the support structures includes powered means for adjusting the vertical position of each of the pair of spaced vertical members and there are control means for storing pre-defined steps for raising and lowering the vertical members and the mattress and for executing the pre-defined steps in combination.

For comfort and sanitary reasons and to provide improved bathing capability for patients, the sling in the preferred embodiment is made of a porous, non-absorbent plastic material and there are drain pan means for placement on the mattress under the sling to catch water passing through the sling including means for draining water from the drain pan means into a receptacle for dumping. Additionally, the sling has a centrally located hole therethrough disposed to be positioned under the genital area of a patient in the sling; and, there is a flap of the sling material for covering the hole and means for releasably fastening the flap over the hole.

DESCRIPTION OF THE DRAWINGS

FIG. 26 is a simplified side view showing how the inclusion of two lockable joints in each of the horizontal support rails allows the horizontal support rails and sling of the present invention to be folded into a chair configuration for transporting a patient through narrow hallways, and the like.

DESCRIPTION OF THE PREFERRED EMBODIMENT

The basic portions of the present invention can be summarized as a sling for holding the patient and a unique support structure for releasably and adjustably holding the sling in relationship to a hospital bed. Additional support structures allow the supported sling to be retained from the home through the hospital for a minimum of patient inconvenience.

Figure 5:
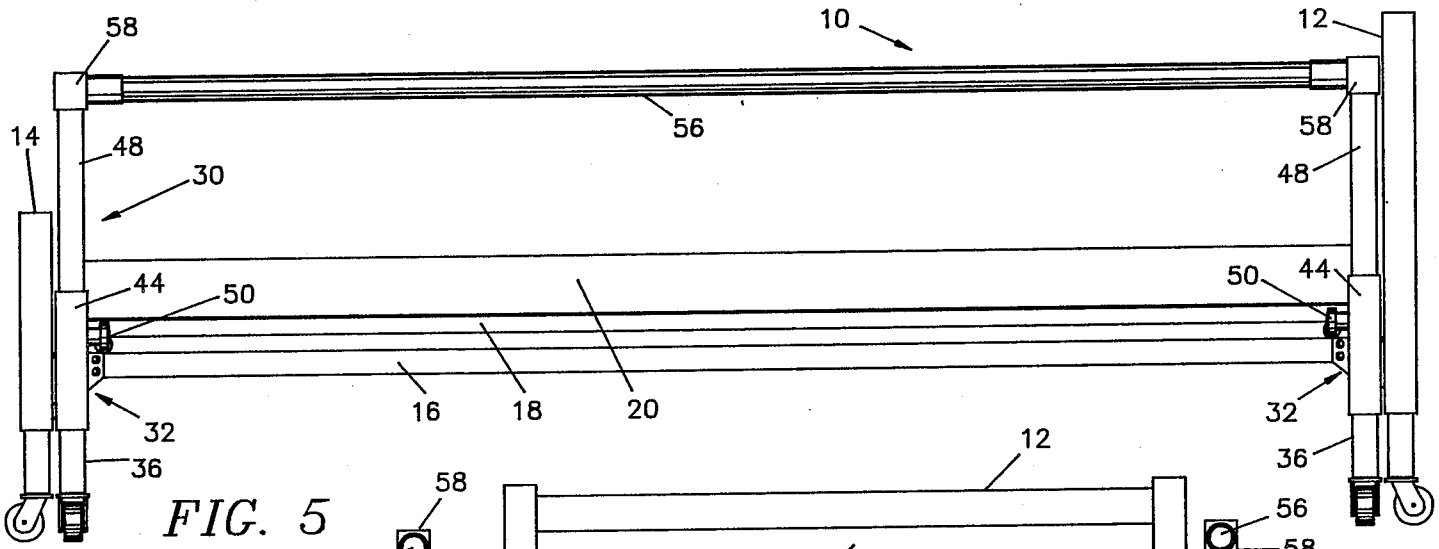
FIG. 5 is a side view of the hospital bed of FIG. 1 showing the support structure of the present invention attached thereto.
Figure 6:
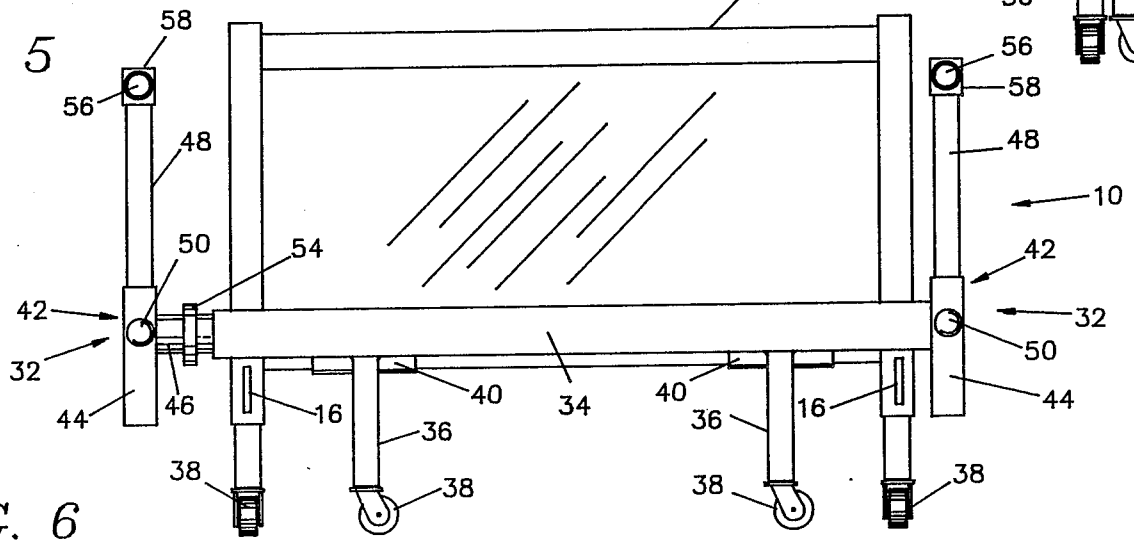
FIG. 6 is an inside headboard end view of the bed and support structure of FIG. 5.
Figure 7:
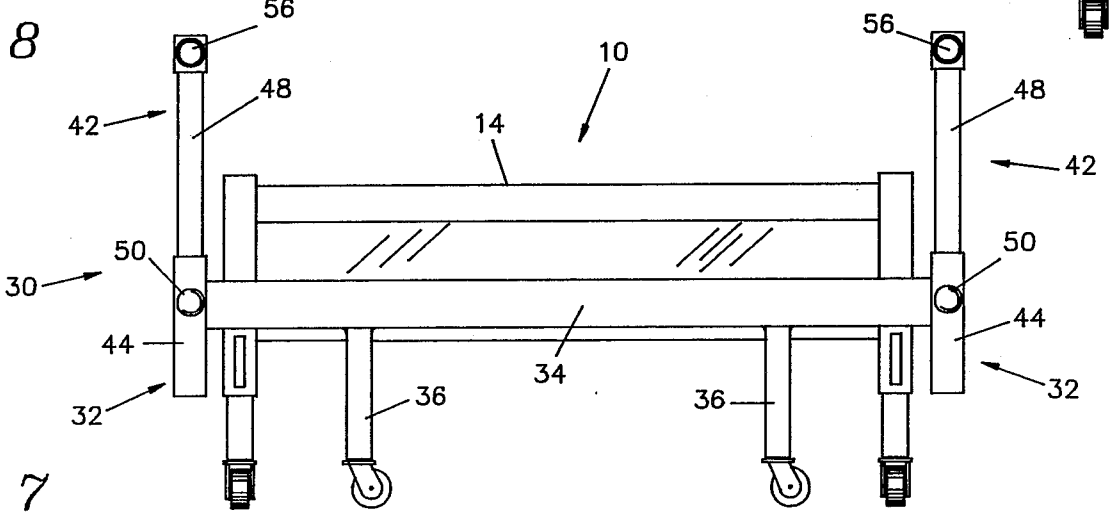
FIG. 7 is an inside foot end view of the bed and support structure of FIG. 5.

The basic elements of the support structure, generally indicated as 30, are shown in FIGS. 5–7. Except as specifically pointed out as an exception to the general rule, the support structure is constructed of tubular steel stock which is square in cross-section and chromium plated. Such materials are commonly used for hospital equipment as they can be welded together, are strong, and easily cleaned. A pair of support members 32 are disposed inside the headboard 12 and footboard 14 of the hospital bed 10, respectively. Each support member 32 in the preferred embodiment comprises a crossbar 34 having a pair of support legs 36 with casters 38 on the bottom thereof. It is preferred that at least one of the support members 32 be clamped at 40 to the adjacent headboard and/or footboard 12, 14. It will be appreciated by those skilled in the art that this arrangement allows the support structure 30 to be self supporting while, at the same time, being easily movable in combination with the hospital bed 10 which is also supported on casters 38.

Figure 11:
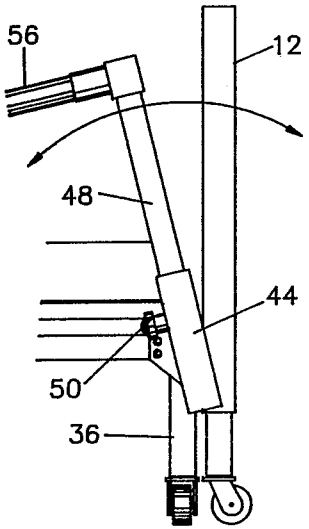
FIG. 11 is a drawing of one corner of the support structure of the present invention in its preferred embodiment showing how the vertical support column can be rotated in a vertical plane about its point of attachment to the support frame.
Figure 9:
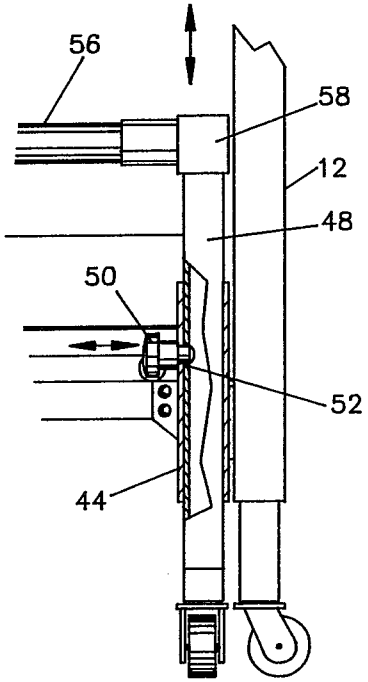
FIG. 9 is a drawing of one corner of the support structure of the present invention in its preferred embodiment showing how the vertical support column can be adjustably positioned vertically.

Each of the crossbars 34 has a pair of vertical support columns 42 attached to the respective ends thereof. Each vertical support column 42 comprises a main member 44 disposed vertically with a cylindrical member 46 extending outward from the side. The cylindrical members 46 fit into the ends of the crossbars 34 and, being round in cross section, allow the main members 44 to be pivoted or rotated in a vertical plane as depicted in FIG. 11. There is an inner vertical member 48 slidably disposed within each of the main members 44. Each main member 44 is provided with a release catch 50 having a projection which fits into a plurality of holes 52 provided in the vertical members 48. In this manner, the inner vertical members 48 can be positioned and held in a number of vertical positions in a manner well known in the art of hospital equipment as depicted in FIG. 9. If desired and/or needed, one or more spacers 54 can be placed over the cylindrical members 46 to force the main members 44 outward and thereby increase the tension on the sling portion to be described shortly.

Figure 10:
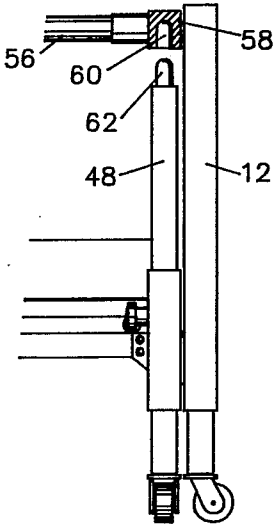
FIG. 10 is a drawing of one corner of the support structure of the present invention in its preferred embodiment showing how the horizontal support rail is removably attached to the top of the vertical support column.

Finally with respect to the support structure 30, there are a pair of horizontal support rails 56 releasably attached between the tops of the vertical members 48 on either side of the bed 10. It is preferred that the rails 56 be cylindrical in cross section. One method of releasable attachment is shown in FIG. 10. Each end of the rails 56 is provided with an end member 58 having a socket 60 formed therein which slides over a projection 62 on the top of the vertical member 48 provided for the purpose. As should be appreciated, the support structure 30, as described above, does not interfere with the normal operation of the hospital bed 10. This is important as the electrically powered features of the bed 10 are incorporated into the obtaining of some of the objectives of the present invention.

Figure 8:
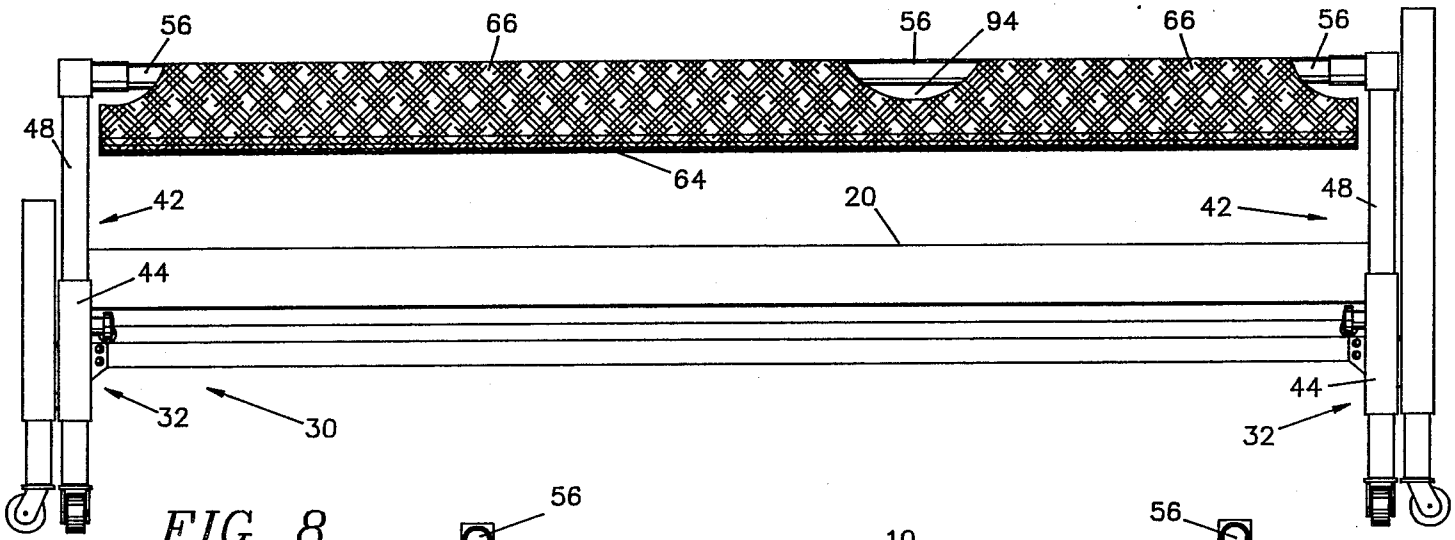
FIG. 8 is a side view showing the support sling of the present invention attached to the support structure.
Figure 23:
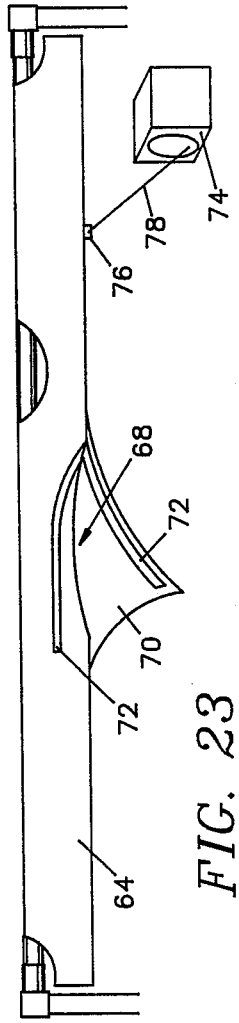
FIG. 23 is a simplified side view of the horizontal support rails and sling of the present invention showing the preferred incorporation of a closable access hole in the center of the sling and the releasable attachment of a rocking mechanism thereto.
Figure 24:
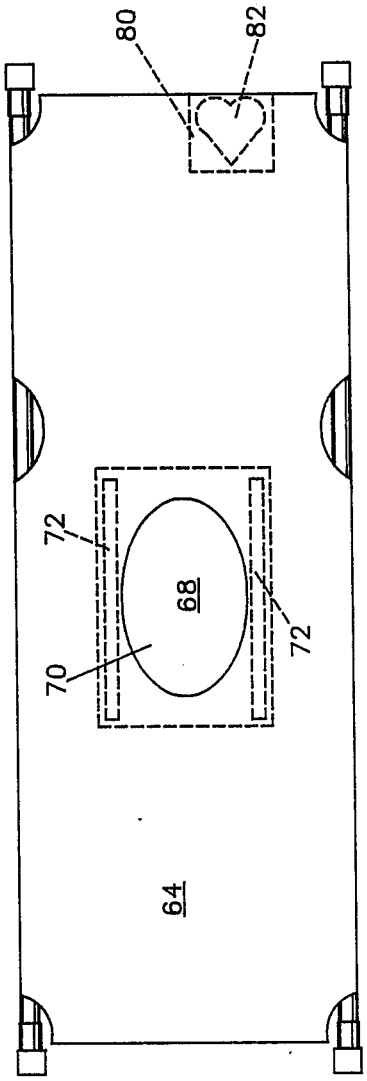
FIG. 24 is a top view of FIG. 23 showing the access hole and the preferred provision of a pocket in the sling for the placement of a heartbeat simulation mechanism therein.
Figure 28:
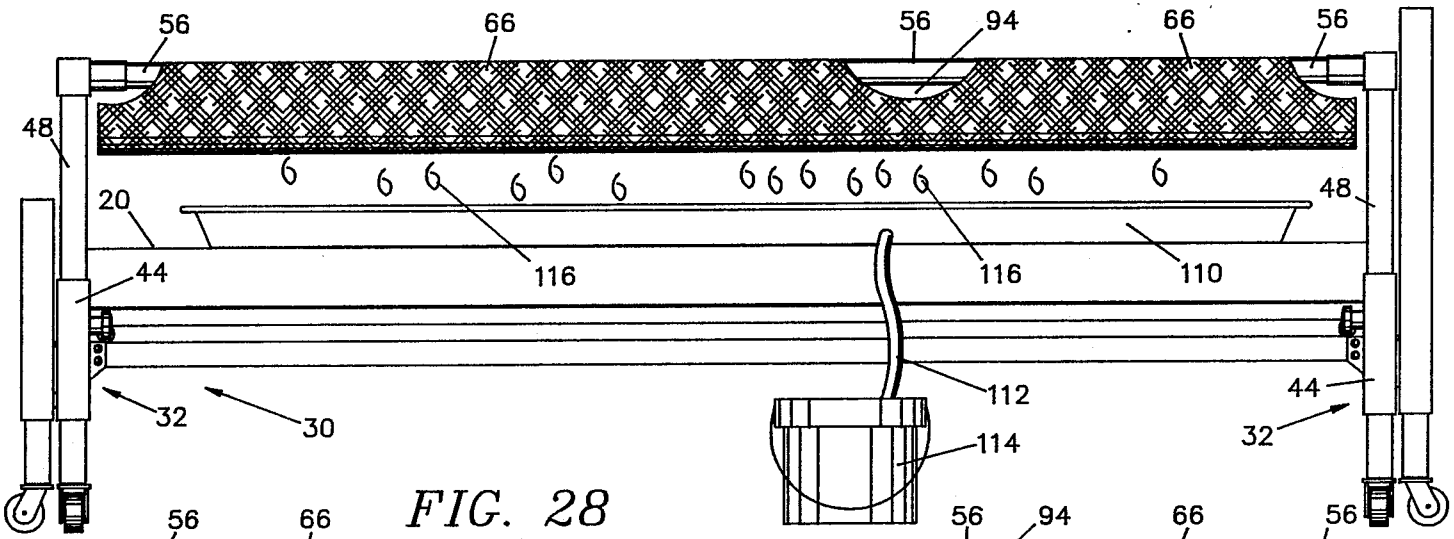
FIG. 28 is a side view showing how the raised sling construction and the porous, non-absorbant material employed in the sling provide a unique environment for bathing a patient therein with water which is caught in a drain pan disposed on the top of the mattress under the patient.
Figure 29:
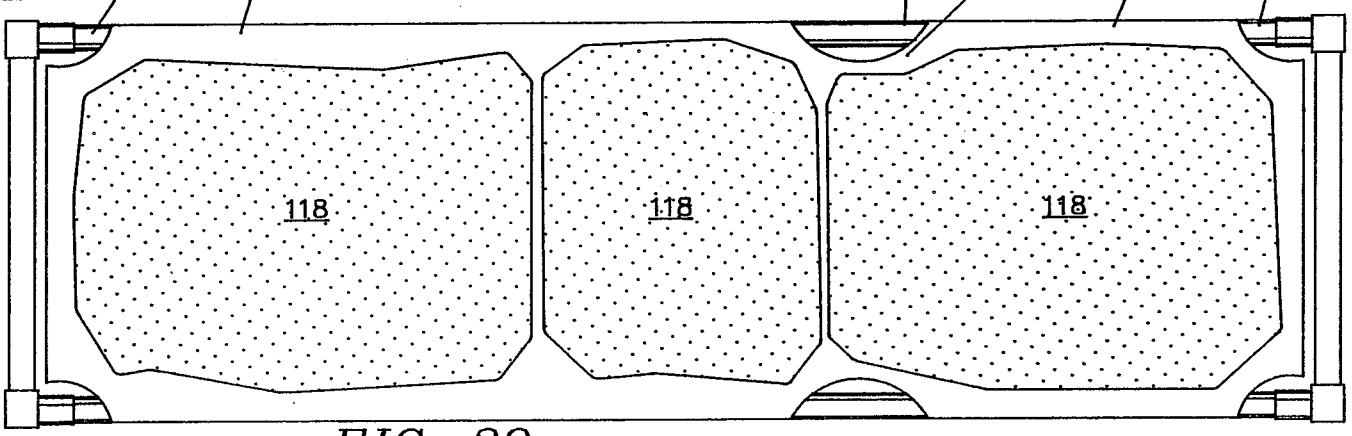
FIG. 29 is a top view of the sling of the present invention showing the preferred addition of a three part fleece covering for the sling.

Turning now to FIG. 8, the support structure 30 is shown with the sling 64 attached thereto. The basic structure of the sling 64, per se, is not unique and, in fact, is similar to the structure of the familiar folding canvas "army cot". The sling 64 is a rectangular piece of material having tubular pockets 66 sewn into the sides through which the rails 56 can be slid. The preferred material is a woven plastic material of the type commonly employed for football jerseys as it is lightweight, strong, slightly deformable, porous and sanitary (in that it does not absorb liquid). All these qualities make it particularly suitable for its particular use. It is also inexpensive and easily replaced so as to be particularly adapted to the above-stated object of disposability—as is a very important consideration and benefit of the present invention over the prior art with respect to certain afflictions, such as AIDS. Note that while the canvas covering of the old army cot was stretched taught from both sides and the ends, the sling 64 is supported only on the sides and (depending on the number of spacers 54 employed) can be maintained in a somewhat "sagging" state so as to provide a cuddling environment for a patient, if desired. As shown in FIGS. 23 and 24, the preferred sling 64 has a hole 68 in the center thereof positioned to be under the genital/-buttocks area of a patient in the sling. The hole 68 can be optionally closed with a flap 70 by means of touch fastener material 72 such as that sold under the trademark Velcro. With incontinent patients, a bedpan can be left under the hole 68 (not possible with a normal hospital bed). Other patients can place the bed pan under themselves for use. Note that because of the combination of the hospital bed 10 in its functional state, the bedpan can be placed on the mattress 20 and then the mattress 20 raised with the controller 24 to place the patient in a convenient and comfortable relationship thereto—without the necessity of the patient actually resting on the bedpan and causing pressure on the patient's posterior regions. This is just one example of how the present invention allows many patients to achieve a feeling of self sufficiency —no matter how minimal. For example, as shown in FIG. 28, a lightweight, plastic drain pan 110 can be positioned on the mattress 20 under a patient in the sling 64 for bathing with water. The drain pan 110 is connected by means of a hose 112 to a bucket 114. Because of the nature of the preferred material employed in the sling 64 (i.e. porous and non-absorbant) water 116 passes through the sling material and into the pan 110 from whence it drains through the hose 112 into the bucket 114 for disposal. It should also be noted in passing that in the tested embodiment of the present invention as employed with seriously ill patients, a three part fleece 118 was placed over the sling 64 to provide a more comforting and pressure point resistant surface for the patient. There is also the providing of a pile surface affording tactile stimulation—which has been found to have a comforting effect as opposed to a hard, flat-surfaced mattress with a sheet on the top. As will be noted from the figures, rather than being stretched taught as with the prior art army cot, the sling 64 of the present invention is suspended between the horizontal support rails 56 in a drooping fashion that causes the patient to be suspended between raised sides. Thus, rather than being exposed to view on the top of a flat-surfaced mattress for all to see, the patient in his or her vulnerable state is cuddled in a valley away from prying eyes in an environment of peace and comfort. The edges of the fleece 118 had ties for affixing the fleece 118 to the framework surrounding it so as to prevent slippage. Also, the three portions of the fleece 118 were joined at their abutting edges with touch fastener material such as sold under the trademark Velcro to prevent separation of the portions. This arrangement offers the benefit of being able to replace only the smaller central portion should it become soiled in use.

Several other features of the preferred sling 64 are depicted in FIGS. 23 and 24. For one, it is preferred that the sling 64 have some means of attachment for a rocking mechanism 74. This can be accomplished conveniently by merely providing one or more tabs 76 to which a line 78 from the rocking mechanism 74 can be releasably attached. One of the inventors herein is also the inventor of technology related to the present invention as employed with newborn infants for both normal and therapeutic purposes. Based on that prior experience, she tried similar techniques with adults in the testing of the present invention with actual adult hospital patients and found, for example, that for terminally ill patients, and the like, the mental state becomes very childlike in its responses such that gentle rocking is very soothing and comforting. In like manner, the preferred sling 64 incorporates a pocket 80 for receiving and holding a heartbeat sound simulation device 82 therein. As with the rocking, the gentle "thump-thump" sound and vibration pattern induced into the fabric of the sling 64 by the device 82 was found to have a very comforting effect on the same patients who responded to the rocking motion.

Figure 13:
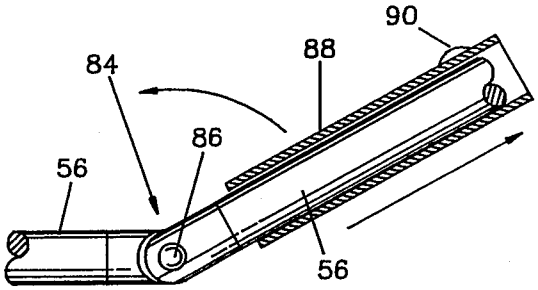
FIG. 13 is a drawing of the portion of the horizontal support rail of FIG. 12 with the joint in an unlocked and rotated position.
Figure 12:
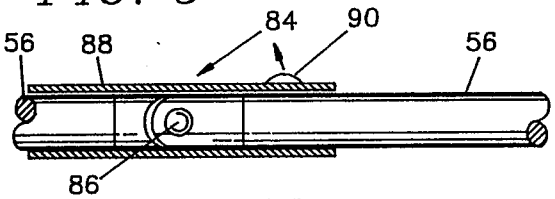
FIG. 12 is a drawing of a portion of the horizontal support rail in its preferred embodiment having a locking joint incorporated therein with the joint in its locked position.

For purposes to the discussed momentarily, it is preferred that the horizontal support rails 56 each have a similarly positioned lockable joint 84 incorporated therein as shown in FIGS. 12 and 13 whereby the portions of the rails 56 on either side of the joint 84 can be pivoted with respect to one another about opposed pivot pins 86. A cylindrical locking sleeve 88 is slidably mounted over the joint 84. Preferably, the locking sleeve 88 is maintained in position by a leaf spring-biased locking button 90 to prevent the sleeve 88 from being slid from its locked position of FIG. 12 by accident. In its locked position of FIG. 12, the joint 84 is held rigid by the sleeve 88. Thus, the rail 56 acts like a solid bar for purposes of supporting the sling 64. When the button 90 is lifted and the sleeve 88 slid to its unlocked position of FIG. 13, however, the joint 84 is free to moved in pivoted motion as depicted in FIG. 13. The use of this feature in two different ways will be demonstrated shortly. Note that where there is a joint 84, an opening 94 must be provided in the pocket 66 to allow access to the sleeve 88 and provide for proper flexing of the joint.

Figure 14:
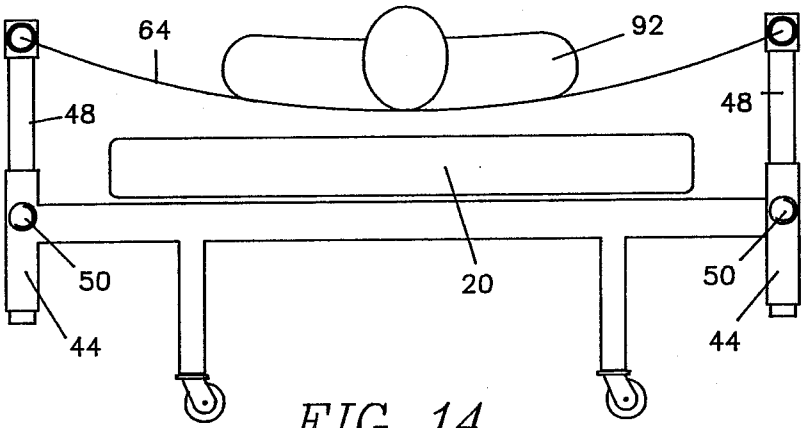
FIG. 14 is a simplified head end view of the present invention in the process of supporting a patient in the sling thereof.
Figure 15:
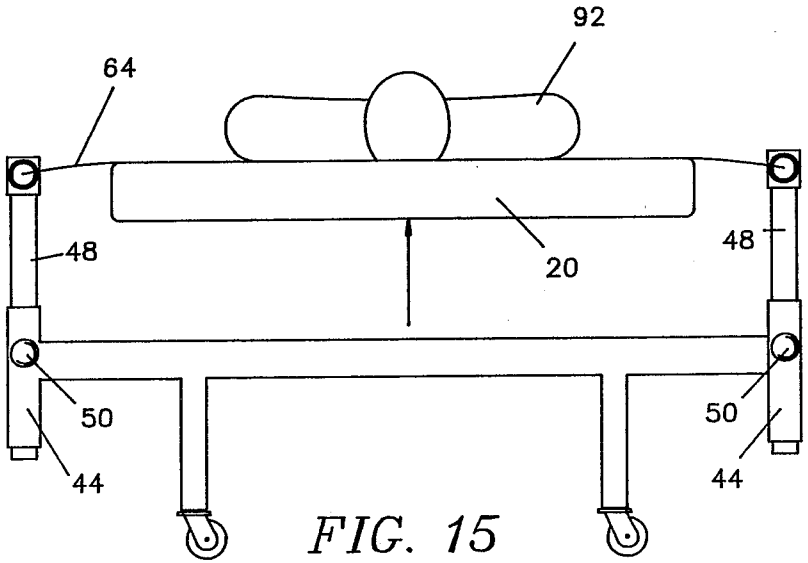
FIG. 15 is a simplified head end view of the present invention in the process of supporting a patient on the mattress of the bed raised under the sling thereof.

Turning now to the simplified drawings of FIGS. 14-17, the use of the present invention in combination with the powered features of the hospital bed 10 to achieve additional objectives will now be described. As depicted in FIG. 14, the patient 92 is normally suspended in the sling 64 above the mattress 20. As depicted in FIG. 15, by using the controller 24, the patient 92 can raise the mattress 20 to be supported thereby. At that point, many patients could then change position on the sling 64 and then lower themselves back to the suspended position of FIG. 14. It should be noted in passing at this point that the preferred material of the sling 64 as described above can have holes cut therethrough without harm to the supporting qualities of the sling 64. Thus, access holes can be provided for administering treatment or to provide non-contacting areas over damaged body areas, if desired. It should also be noted that the position of FIG. 15 is ideally suited for changing the sling 64 should, for example, the material be soiled and require washing. With the weight off of the rails 56, the rails are merely lifted off of the projections 62 and then slid out of the pockets 66. The sling 64 can be removed and a new sling can be positioned under the patient 92 in a manner similar to the known way of changing of a bottom sheet on the bed 10 with the patient 92 in it.

Figure 17:
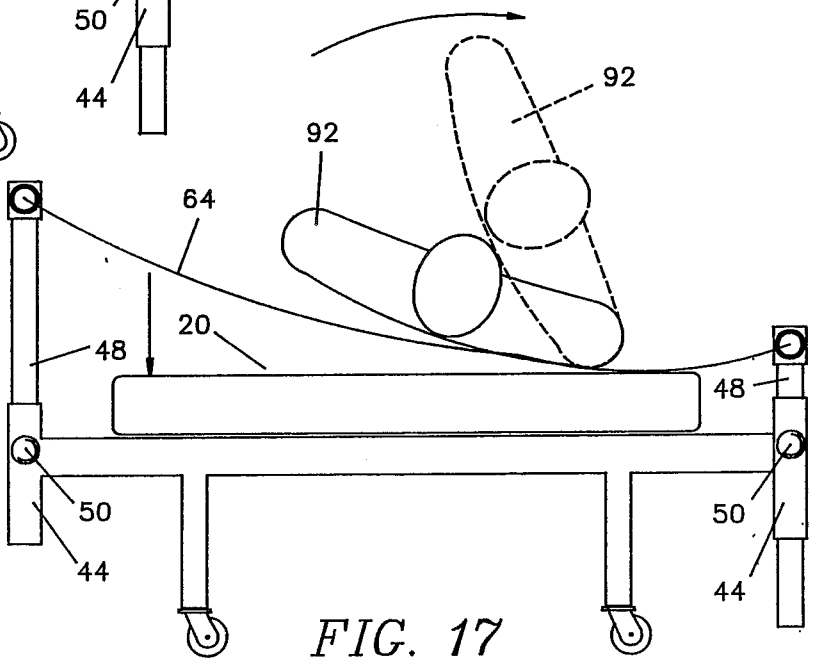
FIG. 17 is a simplified head end view of the present invention in the process of assisting in the turning of a patient.
Figure 16:
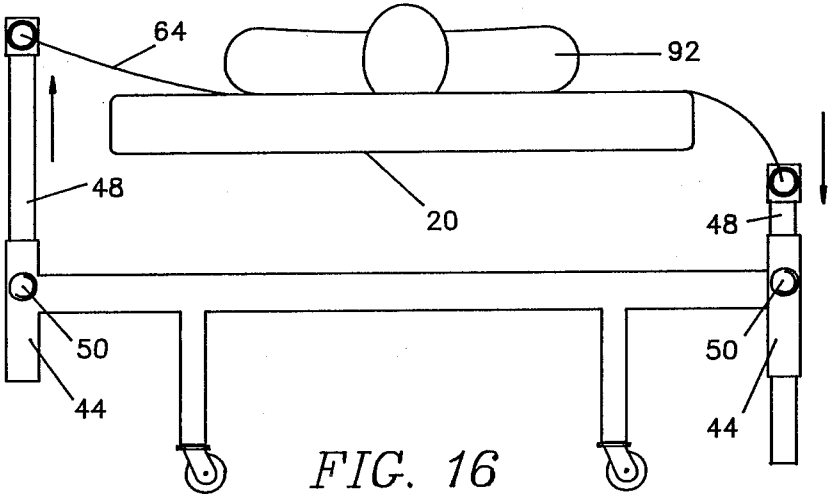
FIG. 16 is a simplified head end view of the present invention in the process of raising the vertical support columns on one side and lowering the vertical support columns on the other side in preparation for using the present invention to assist in turning a patient.

For turning a patient (either by a caretaker or by the patient himself), with the mattress 20 raised as in FIG. 15, the vertical members 48 on one side of the mattress 20 are raised while the members 48 on the other side are lowered as depicted in FIG. 16. The mattress 20 is then lowered as shown in FIG. 17. This places the patient 92 on a slanted surface as formed by the angled sling 64. Being already partially turned from a flat-on-the-back position by the sling 64, the patient 92 can then be turned the rest of the way easily by a single individual (or by gripping a siderail and pulling himself) as depicted in FIG. 17. Having thus described the basic sling and support structure of the present invention in its preferred embodiment, additional features possible with the present invention to accomplish additional objectives thereof will now be described.

Figure 18:
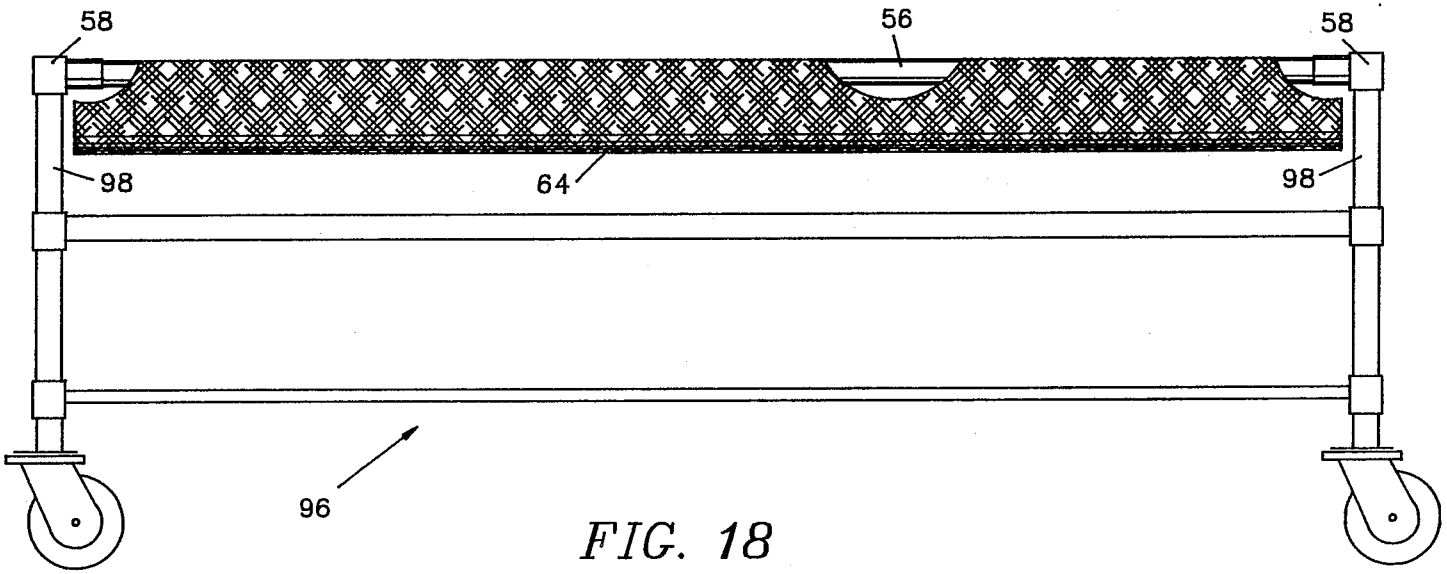
FIG. 18 is a side view drawing showing the horizontal support rails and sling of the present invention attached to a gurney support structure according to the present invention.

Turning first to FIG. 18, the horizontal support rails 56 and sling 64 as described above are shown mounted to a gurney support structure 96 as used for transporting patients within a hospital. The support structure 96 could be separate from the normal gurney or a normal gurney could be adapted for use with the present invention by adding removable support posts 98 at the corners.

Figure 19:
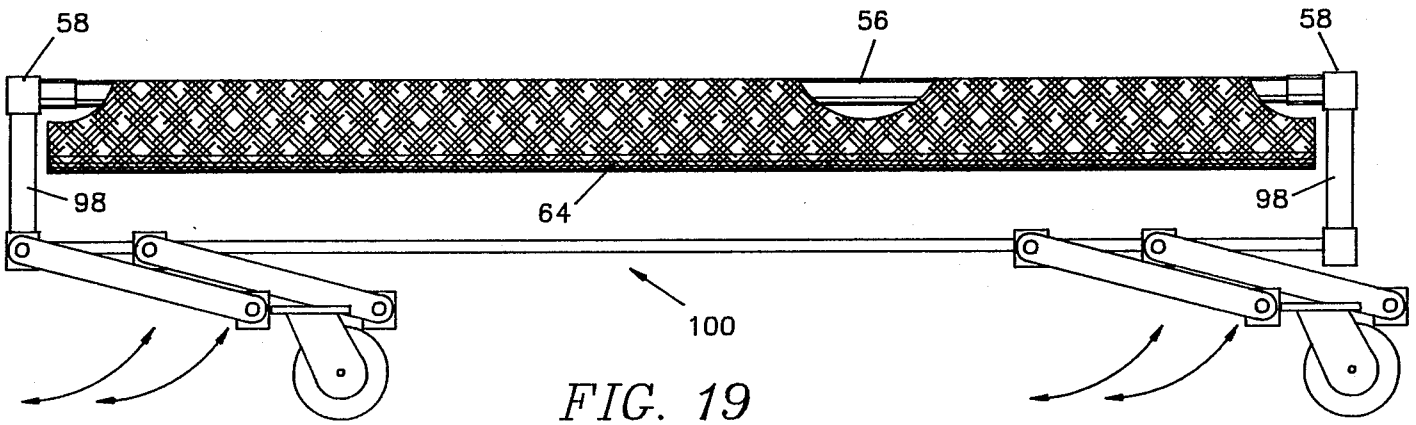
FIG. 19 is a side view drawing showing the horizontal support rails and sling of the present invention attached to an ambulance stretcher support structure according to the present invention.
Figure 22:
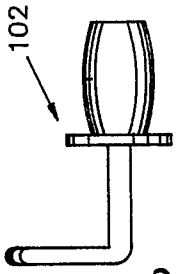
FIG. 22 is an enlarged drawing of the handle of FIGS. 20 and 21.
Figure 21:
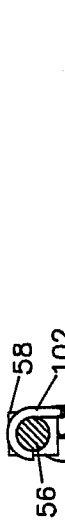
FIG. 21 is a cutaway drawing showing the manner of attachment of the handle of FIG. 20.
Figure 20:
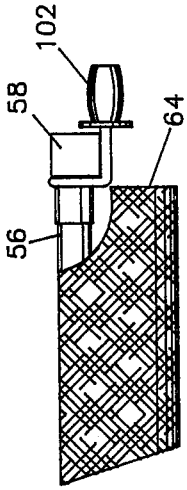
FIG. 20 is a side view drawing showing a removable handle attached to the horizontal support rail for use is moving the horizontal support rails and sling of the present invention from one support structure to another.

A similar modification of an ambulance stretcher is depicted in FIG. 19 where the horizontal support rails 56 and sling 64 as described above are shown mounted to a stretcher support structure 100. Like the gurney, the stretch support structure 100 could be separate from the normal stretcher or a normal stretcher could be adapted for use with the present invention by adding removable support posts 98 at the corners. In any event, by using the removable handles 102 of FIGS. 20–22, the horizontal support rails 56 and sling 64 can be employed as a hand-held stretcher and then be moved to the stretch support structure 100, the gurney support structure 96, and finally the bed support structure 30 without ever having to take the patient 92 off of it.

Figure 1:
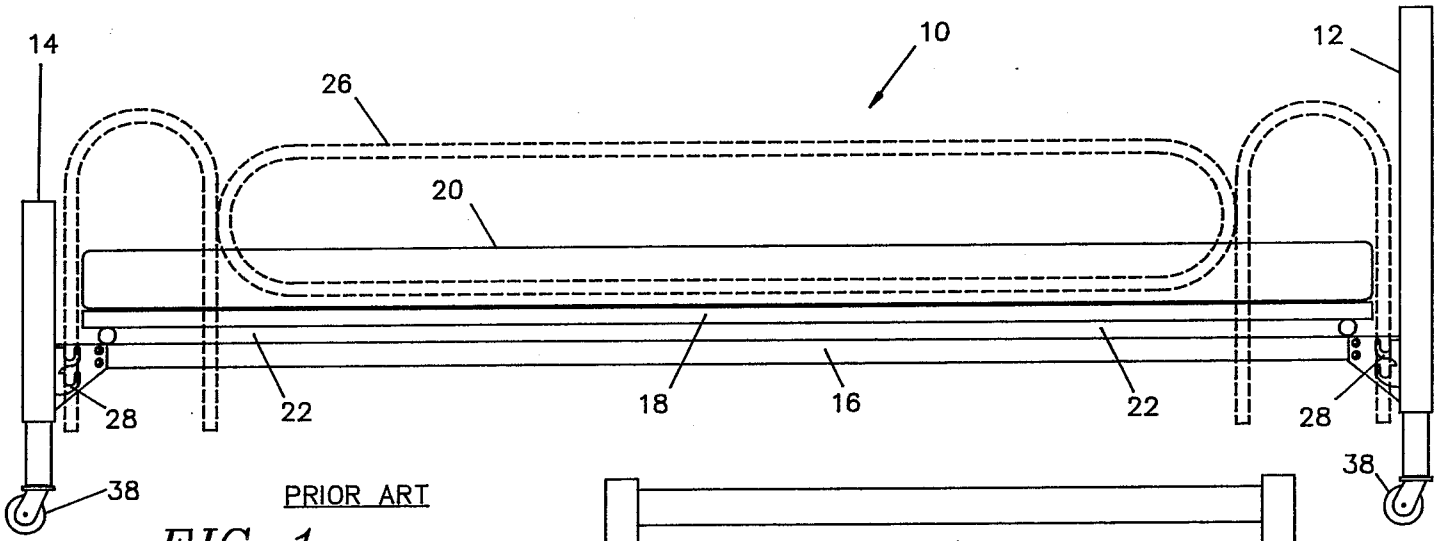
PRIOR ART FIG. 1
FIG. 1 is a side view of a typical hospital bed as with which the present invention is intended to be used in combination.
Figure 2:
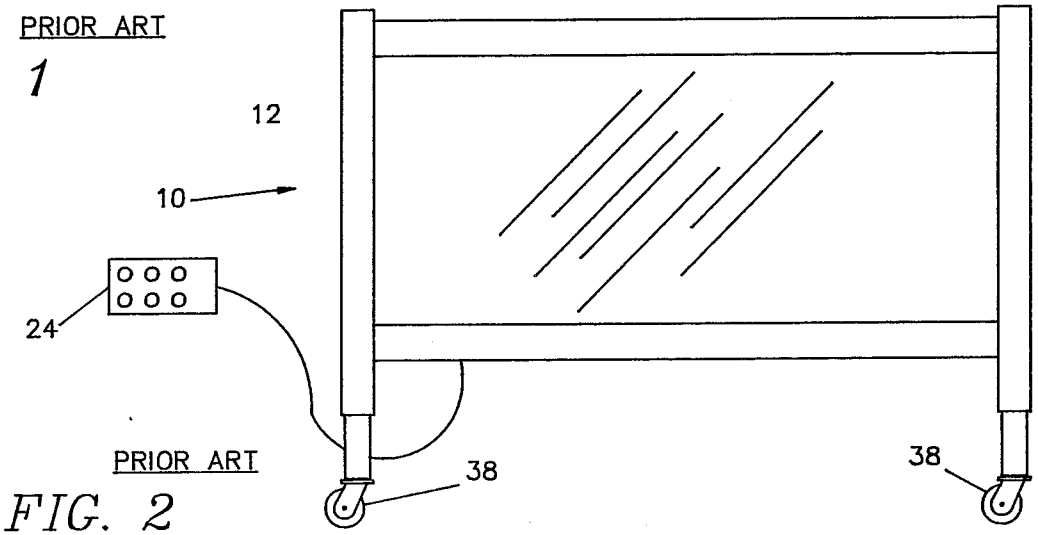
PRIOR ART FIG. 2
FIG. 2 is an outside end view of the headboard portion of the hospital bed of FIG. 1.
Figure 3:
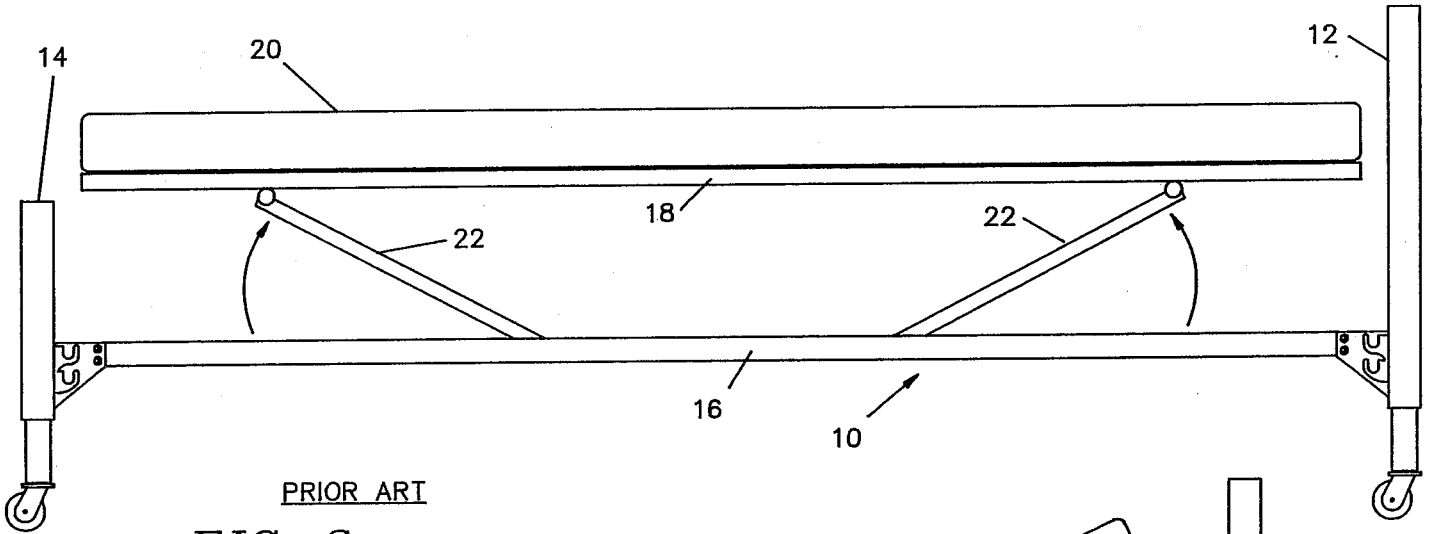
PRIOR ART FIG. 3
FIG. 3 is a side view of the hospital bed of FIG. 1 showing how the mattress can be raised and lowered in a horizontal position by an electrically powered drive system incorporated therein.
Figure 4:
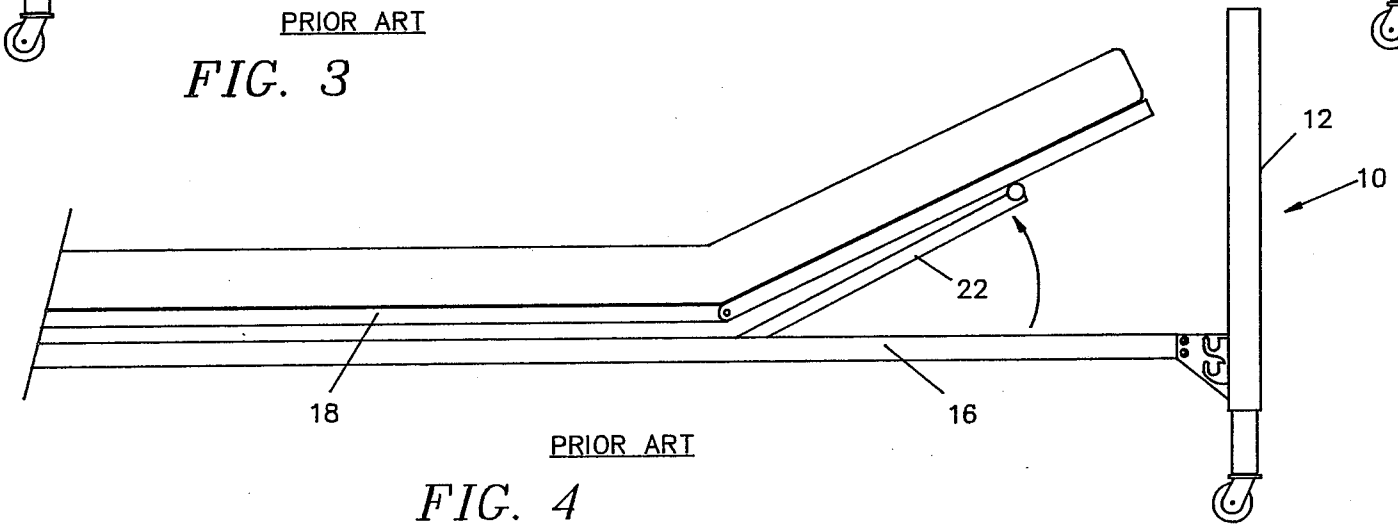
PRIOR ART FIG. 4
FIG. 4 is a side view of the hospital bed of FIG. 1 showing how the mattress can be raised at the head end for sitting up by the electrically powered drive system incorporated therein.
Figure 25:
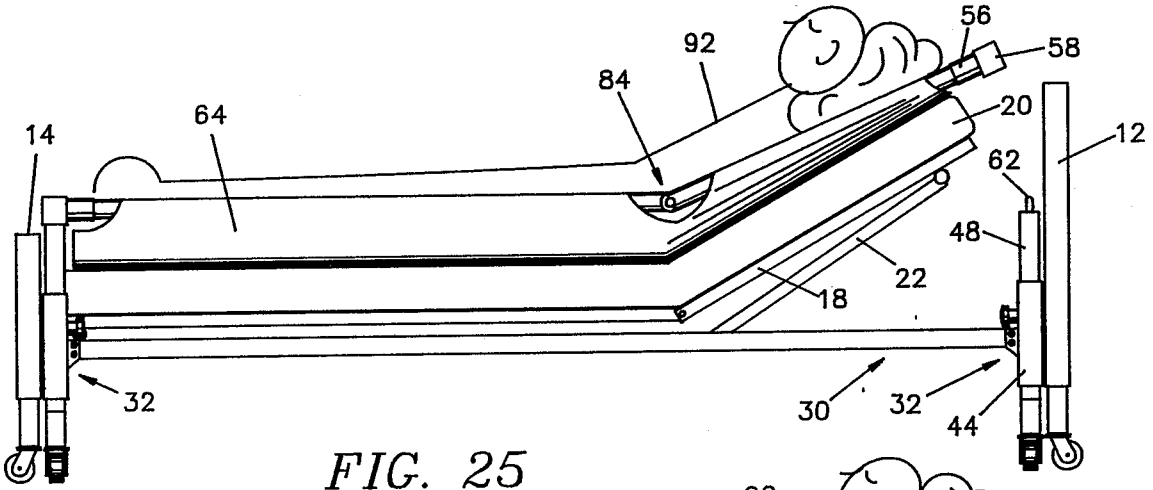
FIG. 25 is a simplified side view showing how the present invention can be used in combination with the bed feature of FIG. 4 to allow the patient to sit up.
Figure 26:
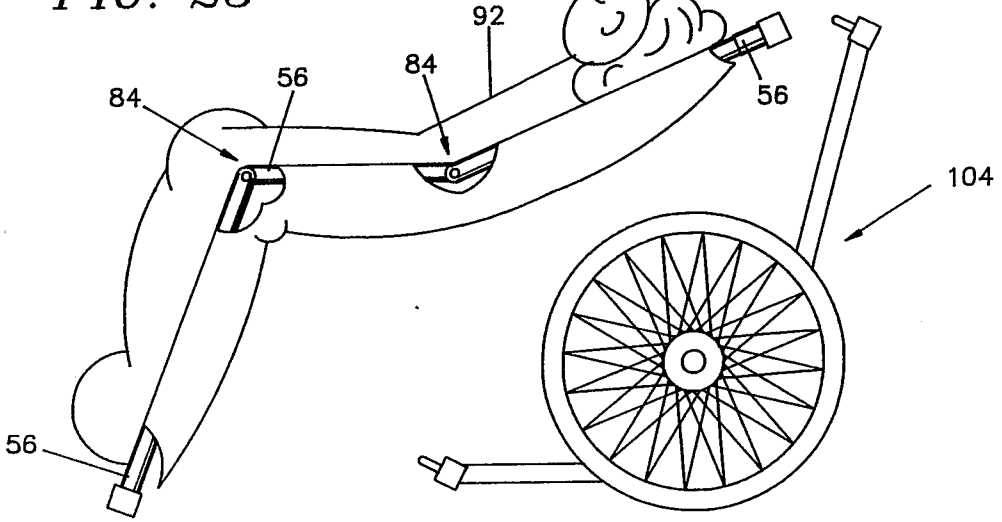

As depicted in the simplified drawings of FIGS. 25 and 26, the joint structure of FIGS. 12 and 13 can be employed to provide additional advantages to the present invention. With a single pair of joints 84 located in the rails 56 above the point where the bed 10 pivots for allowing the patient to sit up as previously shown in FIG. 4, the patient 92 can employ the sitting up aspects of the bed 10 without having to be removed from the sling 64. By providing a second set of joints 84 in the rails 56 at a patient's knee position as shown in FIG. 26, the horizontal support rails 56 and sling 4 can be employed in a "chair" configuration for moving through tight areas and, for example, in moving a patient by airplane. An optional wheelchair support structure 104 could, of course, be employed to grip the horizontal support rails 56, if desired. By making the joints 84 lockable at various points in their rotation in any of several manners well known in the art, the support rails 56 could be made to retain a self-supporting "chair" orientation, if needed. Such an arrangement would be beneficial, for example, in getting a patient onto and off of an airplane, or the like.

Figure 27:
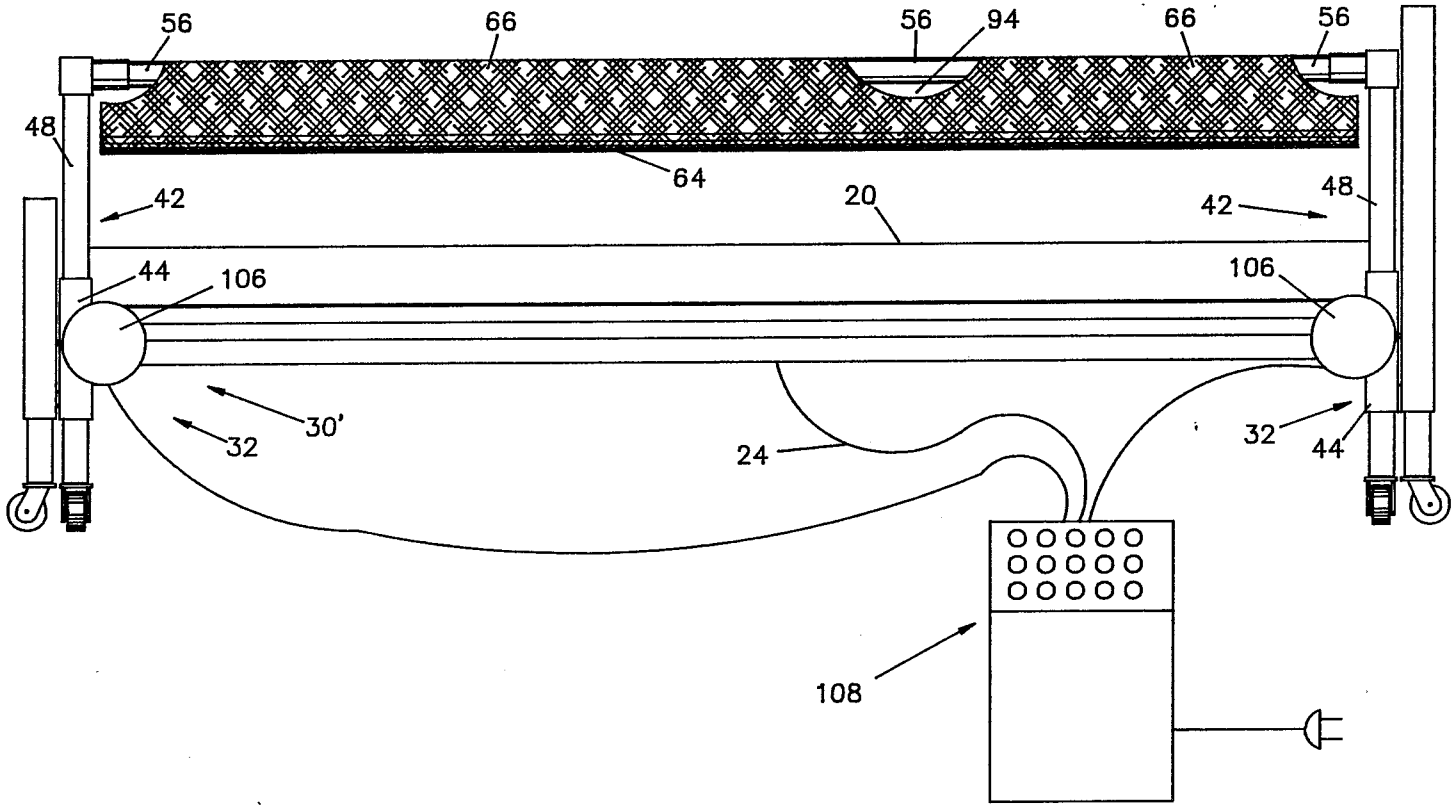
FIG. 27 is a side view showing an alternate embodiment for the bed support structure wherein the vertical supports are power driven and computer controlled to perform various maneuvers automatically.

Finally, as depicted in FIG. 27, the support structure 30' can be automated to provide various patient services (such as the combination of FIGS. 14–17 or raising or lowering of the feet or head) in an automated manner by either a caretaker or the patient himself. For this purpose, the inner vertical members 48 are connected to the main members 44 by electrical drives 106. The electrical drives 106 and the controller 24 of the bed 10 are connected to a computerized controller 108. By selecting the desired option on the controller 108 the patient 92 (or a staff member) can cause the bed 10 and support structure 30', in combination, to go through the necessary steps of the procedure.

Thus, it can be seen that the present invention can be employed to provide a broad spectrum of improvements for hospital patients, and the like, during transport and bed confinement.

Wherefore, having thus described our invention, what is claimed is:

1. In a hospital bed having a mattress disposed between a spaced headboard and footboard and a mechanized drive for raising and lowering the matress, the improvement for increasing patient comfort and convenience comprising:

(a) a first support structure disposed between the footboard and the mattress, said first support structure including a pair of spaced vertical first members disposed at respective ones of a pair of foot corners of the mattress and including a first horizontal member having respective ones of said first members mounted for rotational movement in a vertical plane at opposite ends thereof;

(b) a second support structure disposed between the headboard and the mattress, said second support structure including a pair of spaced vertical second members disposed at respective ones of a pair of head corners of the mattress and including a second horizontal member having respective ones of said second members mounted for rotational movement in a vertical plane at opposite ends thereof;

(c) a pair of rigid side rails disposed between respective ones of said first and second members along and above upper side edges of the mattress; and, (d) a fabric sling disposed between said side rails.

2. The improvement to a hospital bed of claim 1 wherein:

said side rails are releasably attached to the tops of said vertical members by a vertical pin on one of them fitting into a socket on the other of them.

3. The improvement to a hospital bed of claim 1 wherein:

said side rails include opposed, lockable, pivoting joints therein.

4. The improvement to a hospital bed of claim 1 wherein:

each of said support structures includes means for adjusting the vertical position of each of said pair of spaced vertical members.

5. The improvement to a hospital bed of claim 4 wherein:

said means for adjusting the vertical position of each of said pair of spaced vertical members is a powered means.

6. The improvement to a hospital bed of claim 5 wherein:

(a) said means for adjusting the vertical position of each of said pair of spaced vertical members includes means for adjusting each of the four said vertical members individually; and additionally including, (b) control means for storing pre-defined steps for raising and lowering said vertical members and for executing said pre-defined steps in combination.

7. The improvement to a hospital bed of claim 6 wherein:

(a) the meehanized drive for raising and lowering the mattress is operably connected to be operated by said control means; and, (b) said control means includes means for storing additional pre-defined steps for raising and lowering the mattress and for executing said additional pre-defined steps in combination with said pre-defined steps whereby the relationship between the mattress and said sling and the position of said sling can be moved through a series of steps in combination automatically.

8. The improvement to a hospital bed of claim 1 and additionally comprising:

means for adjusting the spacing between said first members and the spacing between said second members whereby the sag of said sling can be adjusted.

9. A patient comfort and convenience device for use in conjunction with a hospital bed having a mattress disposed between a spaced headboard and footboard and a mechanized drive for raising and lowering the mattress comprising:

(a) a first support structure disposed between the footboard and the mattress, said first support structure including a pair of spaced vertical second members disposed at respective ones of a pair of foot corners of the mattress and including a first horizontal member having respective ones of said first members mounted for rotational movement in a vertical plane at opposite ends thereof;

(b) a second support structure disposed between the headboard and the mattress, said second support structure including a pair of spaced vertical second members disposed at respective ones of a pair of head corners of the mattress and including a second horizontal member having respective ones of said second members mounted for rotational movement in a vertical plane at opposite ends thereof;

(c) a pair of rigid side rails disposed between respective ones of said first and second members along and above upper side edges of the mattress; and, (d) a fabric sling disposed between said side rails.

10. The patient comfort and convenience device of claim 9 wherein:

said side rails are releasably attached to the tops of said vertical members by a vertical pin on one of them fitting into a socket on the other of them.

11. The patient comfort and convenience device of claim 9 wherein:

said side rails include opposed, lockable, pivoting joints therein.

12. The patient comfort and convenience device of claim 9 wherein:

each of said support structures includes means for adjusting the vertical position of each of said pair of spaced vertical members.

13. The patient comfort and convenience device of claim 12 wherein:

said means for adjusting the vertical position of each of said pair of spaced vertical members is a powered means.

14. The patient comfort and convenience device of claim 13 wherein:

(a) said means for adjusting the vertical position of each of said pair of spaced vertical members includes means for adjusting each of the four said vertical members individually; and additionally including, (b) control means for storing pre-defined steps for raising and lowering said vertical members and for executing said pre-defined steps in combination.

15. The patient comfort and convenience device of claim 14 wherein:

(a) the mechanized drive for raising and lowering the mattress is operably connected to be operated by said control means; and, (b) said control means includes means for storing additional pre-defined steps for raising and lowering the mattress and for executing said additional pre-defined steps in combination with said pre-defined steps whereby the relationship between the mattress and said sling and the position of said sling can be moved through a series of steps in combination automatically.

16. The patient comfort and convenience device of claim 9 and additionally comprising:

means for adjusting the spacing between said first members and the spacing between said second members whereby the sag of said sling can be adjusted.

17. In a hospital bed having a mattress disposed between a spaced headboard and footboard and a mechanized drive for raising and lowering the mattress, the improvement for increasing patient comfort and convenience comprising:

(a) a first support structure disposed between the footboard and the mattress, said first support structure including a pair of spaced vertical first members disposed at respective ones of a pair of foot corners of the mattress;

(b) a second support structure disposed between the headboard and the mattress, said second support structure including a pair of spaced vertical second members disposed at respective ones of a pair of head corners of the mattress;

(c) a pair of rigid side rails disposed between respective ones of said first and second members along and above upper side edges of the mattress;

(d) a fabric sling disposed between said side rails; and, (e) means for adjusting the spacing between said first members and the spacing between said second members whereby the sag of said sling can be adjusted.

18. A patient comfort and convenience device for use in conjunction with a hospital bed having a mattress disposed between a spaced headboard and footboard and a mechanized drive for raising and lowering the mattress comprising:

(a) a first support structure disposed between the footboard and the mattress, said first support structure including a pair of spaced vertical first members disposed at respective ones of a pair of foot corners of the mattress;

(b) a second support structure disposed between the headboard and the mattress, said second support structure including a pair of spaced vertical second members disposed at respective ones of a pair of head corners of the mattress;

(c) a pair of rigid side rails disposed between respective ones of said first and second members along and above upper side edges of the mattress;

(d) a fabric sling disposed between said side rails; and, (e) means for adjusting the spacing between said first members and the spacing between said second members whereby the sag of said sling can be adjusted.

* * * * *